US006205602B1

(12) United States Patent
Dettweiler

(10) Patent No.: US 6,205,602 B1
(45) Date of Patent: Mar. 27, 2001

(54) MULTI-PURPOSE TOOL

(76) Inventor: Henry R. Dettweiler, 4166 Groveland SW., Navarre, OH (US) 44662

( * ) Notice: Subject to any disclaimer, the term of this patent is extended or adjusted under 35 U.S.C. 154(b) by 0 days.

(21) Appl. No.: 09/287,453

(22) Filed: Apr. 7, 1999

(51) Int. Cl.[7] ..... B25D 1/04
(52) U.S. Cl. ..... 7/143; 7/170; 81/23; 227/147
(58) Field of Search ..... 81/44, 20, 23; 29/254, 275; 227/113, 147; 7/143, 146, 147, 167, 169, 170

(56) References Cited

U.S. PATENT DOCUMENTS

| | | | | |
|---|---|---|---|---|
| 2,330,575 | | 9/1943 | Grauding | 1/50 |
| 3,979,040 | | 9/1976 | Denin | 227/113 |
| 4,299,021 | | 11/1981 | Williams | 29/432 |
| 4,676,424 | * | 6/1987 | Meador et al. | 227/147 |
| 5,181,644 | * | 1/1993 | Ferrell | 227/147 |

* cited by examiner

*Primary Examiner*—D. S. Meislin

(74) *Attorney, Agent, or Firm*—Sand & Sebolt

(57) ABSTRACT

A multi-purpose tool includes a weighted driver that can carry either of a pair of rods having different widths for driving different sized fasteners or can carry various other attachments to provide six different tool configurations. Each rod slides within a correspondingly sized hollow sleeve. The weighted driver is repeatedly translated causing one of the rods to slide within its corresponding sleeve and repeatedly impact the head of a fastener to drive the fastener into a desired surface. The rods are each selectively threadably attached to the driver and readily removed therefrom thus permitting the tool to be easily switched between first and second configurations and easily disassembled for storage in a tool belt or in a tool box. A plumb bob tip and a string brace are attachable to the weighted driver to provide a relatively heavy plumb bob, the plumb bob tip being directly attachable to the string brace to provide a relatively lightweight plumb bob. A punch tip and an impact head can be attached to the weighted driver to provide a heavy duty center punch. The impact head and the first rod can be attached to the weighted driver, the first rod slidingly received in the correspondingly sized hollow sleeve, to provide another tool that can direct the blows of hammers to very small areas for use in numerous capacities.

20 Claims, 5 Drawing Sheets

MULTI-PURPOSE TOOL

BACKGROUND OF THE INVENTION

1. Technical Field

This invention relates generally to hand tools and, more particularly, to a hand tool used for multiple purposes such as driving nails into surfaces in locations where the nail is inaccessible to a conventional hammer as well as other purposes. Specifically, the invention relates to a device having a weighted driver and a number of attachments that can be used in various combinations and can be used to drive different-sized nails, punch center holes, and operate as a plumb bob.

2. Background Information

Nails are common fasteners utilized in diverse fashions in the construction of building structures and the manufacture of other articles. While fasteners such as screws, staples, adhesives, and the like are well suited to many applications, nails are particularly prevalent in construction and manufacturing capacities inasmuch as nails are inexpensive to produce and can be readily installed with relatively simple tools.

As is well understood in the art, nails are driven into surfaces by application of a compressive force to the head of the nail in the direction of the pointed tip. Such compressive force can be applied to the nail with a conventional hammer. Alternatively, the compressive force can be provided by compressed gases that drive a bolt against the nail head. The compressed gases can be produced either by a compressed air source or an explosive charge, both of which are well-known in the art. Still alternatively, the compressive force can be created by an electric solenoid that magnetically drives a bolt against the nail head, as is likewise known in the art. Each of the aforementioned methods of driving nails are well understood in the relevant art and are suited to driving large numbers of nails with minimal effort. Such devices are not, however, without limitations.

In the construction of building structures, nails must often be driven into corners between adjacent walls and between a wall and the floor or the ceiling. The application of nails in such areas can be difficult inasmuch as conventional hammers and power nailers are too large to gain access to these areas.

For instance, a conventional sixteen ounce claw hammer, as is generally used in the building industry, has a driving head approximately one inch in diameter. Such hammers are difficult to use in accurately tight areas. The use of conventional hammers in tight areas can result in the hammer accidentally hitting the walls, floors, or ceilings, resulting in damage to these structures.

Power nailers have had only limited success in such tight applications because power nailers are rather bulky mechanical devices that are not adapted to be used in tight areas. While power nailers utilizing explosive charges may sometimes be used in tight areas, their utility is limited to the specific application for which the particular explosive charges employed therein are suited. The need thus exists for an inexpensive device that can drive a variety of nails into tight areas such as corners.

A number of devices have attempted to overcome the problems associated with driving nails into such tight areas. For instance, U.S. Pat. No. 3,979,040 to Denin discloses a weighted rod telescopingly disposed within a hollow cylinder. The weighted rod is used to apply a compressive force to the nail head for driving the nail into a surface. While the invention disclosed in Denin is effective for driving nails of a particular size, Denin does not disclose a device that can drive nails of various sizes.

Likewise, U.S. Pat. No. 4,299,021 to Williams discloses a weighted rod telescopingly disposed within a hollow cylinder. Again, the weighted rod is used to apply a compressive force to the head of a nail for driving the nail into a surface. While this invention is useful for driving nails of a specific size into a surface, the invention cannot be used to drive nails of a variety of sizes into tight areas.

Another concern with the design of a multi-purpose tool is the weight of the tool and the overall weight of the tools carried by a workman. A multi-purpose tool suited to drive only a single, or a very few number of nail sizes is of limited value to the workman inasmuch as several such tools suited to drive different size nails would be required to be carried by the workman. Each tool carried by a construction worker adds weight to the worker's workbelt. The weight of the tools requires additional effort to be expended by the workman in moving about the work site, and additionally results in enhanced instability while working on ladders, scaffoldings, and the like. It is thus desired for tools to be versatile and perform as many functions as possible, thereby reducing the overall number of tools in the workbelt and the weight of the workbelt.

A versatile tool for driving nails into tight places would preferably include a weighted driver carrying an elongated rod that is slidingly disposed within a hollow cylinder and adapted to drive a nail disposed within the cylinder. The tool would desirably have rods of different sizes having correspondingly sized cylinders for driving different sized nails. The tool would also desirably have a number of attachments that can be used in various configurations to permit the tool to operate in diverse capacities such as a plumb bob or a center punch. It is thus desired to provide a tool that can be inexpensively produced and that is capable of driving a variety of sizes of nails into tight areas such as inside corners and that is capable of performing other functions.

SUMMARY OF THE INVENTION

In view of the foregoing, an objective of the present invention is to provide a tool capable of driving nails and other fasteners of different sizes.

Another objective of the present invention is to provide a tool that can drive nails and other fasteners into relatively inaccessible locations.

Another objective of the present invention is to provide a tool having a driver that can accept rods of different sizes for driving fasteners of different sizes.

Another objective of the present invention is to provide a tool having a rod that slides within a sleeve for driving a fastener.

Another objective of the present invention is to provide a tool having a plurality of rods that are selectively attachable to a driver, each of the rods having a cooperatively-sized sleeve within which the rod slides.

Another objective of the present invention is to provide a tool wherein the weighted driver is located away from the nail while the nail is being driven.

Another objective of the present invention is to provide a tool that reduces the tendency of a nail to buckle when being driven into a surface.

Another objective of the present invention is to provide a tool having a weighted driver that is formed with holes of two different sizes.

Another objective of the present invention is to provide a tool that includes a weighted driver and a plurality of attachments that can be used in various configurations.

Another objective of the present invention is to provide a tool wherein one of the configurations is a center punch.

Another objective of the present invention is to provide a tool wherein one or more configuration can operate as a plumb bob.

Another objective of the present invention is to provide a tool that provides two different plumb bob configurations of two different weights.

These and other objectives and advantages of the invention are obtained from the multi-purpose tool device, the general nature of which can be stated as including a weighted driver, a first rod having an impact end and an attachment end, the attachment end of the first rod being selectively connectable to the weighted driver, the impact end adapted to impact the fastener, a first sleeve formed with a first bore therein, the first rod configured to slide within the first bore, the first bore adapted to accept the fastener therein, a second rod having an impact end and an attachment end, the attachment end of the second rod being selectively connectable to the weighted driver, the impact end adapted to impact the fastener, a second sleeve formed with a second bore therein, the second rod configured to slide within the second bore, the second bore adapted to accept the fastener therein, and the widths of the first and second rods being unequal whereby the first and second bores can accept fasteners of different sizes.

Other objectives and advantages of the invention are obtained from the method of the present invention, the general nature of which can be stated as including the steps of providing a weighted driver and a first rod, the first rod configured to be selectively carried by the driver, a first sleeve, the first rod adapted to slide within the first sleeve, a second rod, the second rod adapted to be selectively carried by the driver, and a second sleeve, the second rod adapted to slide within the second sleeve, the first and second rods being of different widths, selecting one of the first and second rods, attaching the selected rod to the driver, sliding the selected rod through the correspondingly sized sleeve to contact the fastener, and translating the weighted driver repeatedly and causing the selected rod to repeatedly impact the fastener until the fastener is driven into the surface.

Still other objectives and advantages of the invention are obtained from the multi-purpose tool of the present invention, the general nature of which can be stated as including a weighted driver, a first rod and sleeve assembly, a second rod and sleeve assembly, a plumb bob tip, a string brace formed with a cavity, a punch tip, and an impact head, the weighted driver having first and second opposite ends, the weighted driver having a first hole in said first end and a second hole in said second end, the first rod and sleeve assembly including a first rod and a first sleeve, the first rod being slidably receivable in the first sleeve, the first rod being selectively received in the first hole of the weighted driver, the second rod and sleeve assembly including a second rod and a second sleeve, the second rod being slidably receivable in the second sleeve, the second rod being selectively received in the second hole of the weighted driver, the first rod having a smaller width than the second rod, the plumb bob tip being selectively received in the first hole, the string brace being selectively received in the second hole, the punch tip being selectively received in the first hole, and the impact head being selectively received in the second hole.

BRIEF DESCRIPTION OF THE DRAWINGS

The preferred embodiment of the invention, illustrative of the best mode in which applicant has contemplated applying the principles of the invention, is set forth in the following description and is shown in the drawings and is particularly and distinctly pointed out and set forth in the appended claims.

Similar numerals refer to similar parts throughout the specification.

DESCRIPTION OF THE PREFERRED EMBODIMENT

Figure 2:
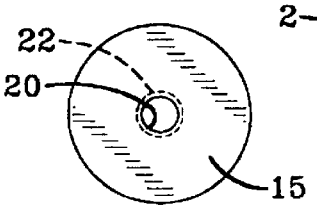
FIG. 2 is a top plan view of the weighted driver of the present invention.
Figure 1:
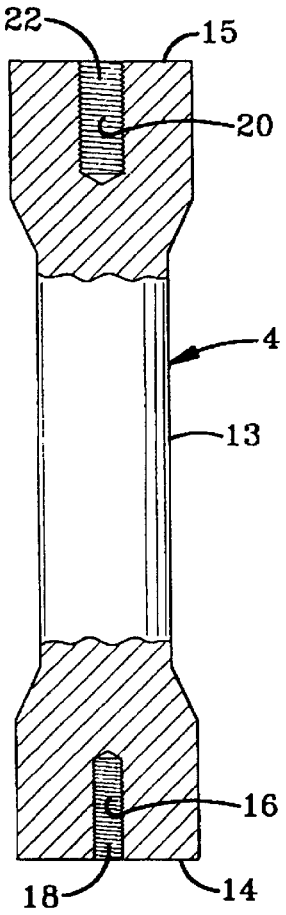
FIG. 1 is a front elevational view of the weighted driver of the multi-purpose tool of the present invention.
Figure 3:
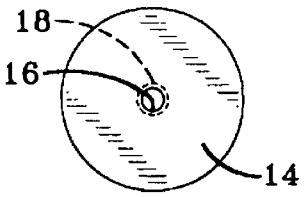
FIG. 3 is a bottom plan view of the weighted driver of the present invention.

The multi-purpose tool of the present invention is indicated generally by the numeral 2 in the accompanying drawings. Tool 2 includes a weighted driver 4, a first rod 6, a second rod 10, a first sleeve 8, a second sleeve 12, a plumb bob tip 63, a string brace 64, a punch tip 73, and an impact head 74. First and second rods 6 and 8 are selectively attachable to weighted driver 4, with first rod 6 telescopingly received within first sleeve 8 and second rod 10 being telescopingly received within second sleeve 12. In use, at most only one of first and second rods 6 and 8 is attached to weighted driver 4 at any given time.

Tool 2 has a first configuration (FIG. 4) in which first rod 6 and first sleeve 8 are used with weighted driver 4. Tool 2 has a second configuration (FIG. 5) in which second rod 10 and second sleeve 12 are used with weighted driver 4. Both the first and second configurations are intended primarily for the driving of nails, but may be used for other appropriate purposes as needed.

Weighted driver 4 is an elongated body fabricated from a relatively heavy material such as cast iron, although other materials can be used without departing from the spirit of the present invention. Driver 4 is an elongated, preferably solid body terminating at a first end 14 and at a second end 15 at opposite ends of driver 4. Driver 4 includes a substantially cylindrical handgrip 13 of a diameter and length suited to allow it to be held in the hand. Handgrip 13 may additionally contain optional knurling (not shown) to assist in gripping driver 4.

Driver 4 is formed with a substantially cylindrical first hole 16 extending inwardly from first end 14. First hole 16 is axially disposed and is substantially perpendicular to first end 14. First hole 16 includes a plurality of internal threads 18 formed on driver 4. Driver 4 is additionally formed with a substantially cylindrical second hole 20 extending inwardly from second end 15. Second hole 20 is also axially disposed and is substantially perpendicular to second end 15. Second hole 20 contains a plurality of internal threads 22 formed on driver 4.

First rod 6 is an elongated body of a strong, tough material such as steel, aluminum, or titanium, although other materials may be used without departing from the spirit of the present invention. First rod 6 is a substantially cylindrical body having an arcuate outer surface 24 and an attachment end 26 at one end thereof. Outer surface 24 of first rod 6 has an external width 36 of substantially constant cross section. First rod 6 terminates at a planar impact end 34 opposite an attachment end 26.

Attachment end 26 contains a plurality of external threads 28 formed thereon. External threads 28 cooperate threadably with internal threads 18.

First rod 6 additionally contains a jam nut 30 having a planar locking surface 32. While jam nut 30 may be a conventional nut threaded onto external threads 28, jam nut 30 may likewise be formed integrally with first rod 6 without departing from the spirit of the present invention.

Figure 6:
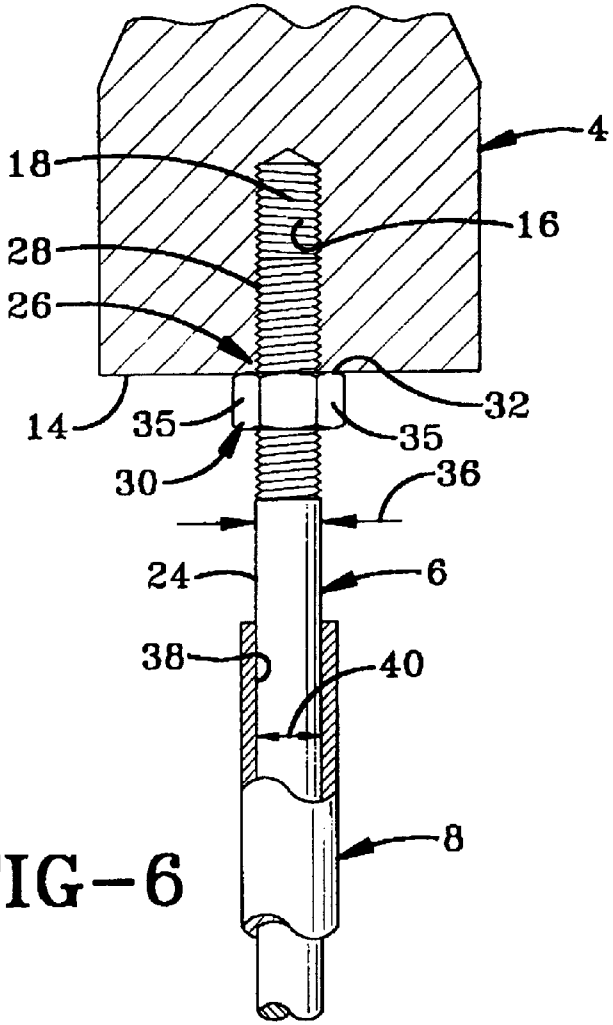
FIG. 6 is an enlarged front elevational view, partially in section, of a portion of the first configuration.

In accordance with the objectives of the present invention, attachment end 26 of first rod 6 is selectively received in first hole 16 of driver 4, with external threads 28 cooperating threadably with internal threads 22. Attachment end 26 is threaded into first hole 16 until locking surface 32 of jam nut 30 is tightened against first end 14. As is best shown in FIG. 6, first hole 16 is preferably of a depth sufficient to allow attachment end 26 to be fully inserted into first hole 16 with locking surface 32 locking against first end 14. Jam nut 30 is preferably formed with at least a pair of parallel and spaced apart flats 35 which can be engaged by the jaws of a wrench (not shown) for installing and tightening attachment end 26 into first hole 16.

In accordance with the objectives of the present invention, first rod 6 is telescopingly received within first sleeve 8. First sleeve 8 is an elongated body formed with a substantially cylindrical first bore defining an inner surface 38. Inner surface 38 has an internal width 40 of substantially constant circular cross section. External width 36 of first rod 6 is preferably nominally smaller than internal width 40 of first sleeve 8 thus allowing first rod 6 to slide smoothly within first sleeve 8.

Figure 4:
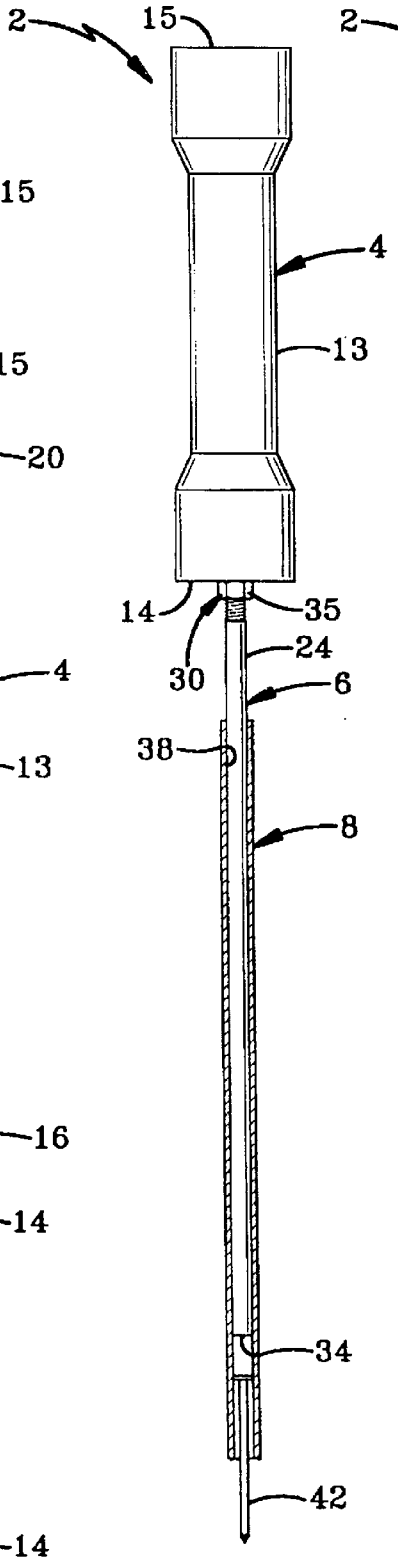
FIG. 4 is a front elevational view that is partially in section of a first configuration of the tool of the present invention.
Figure 5:
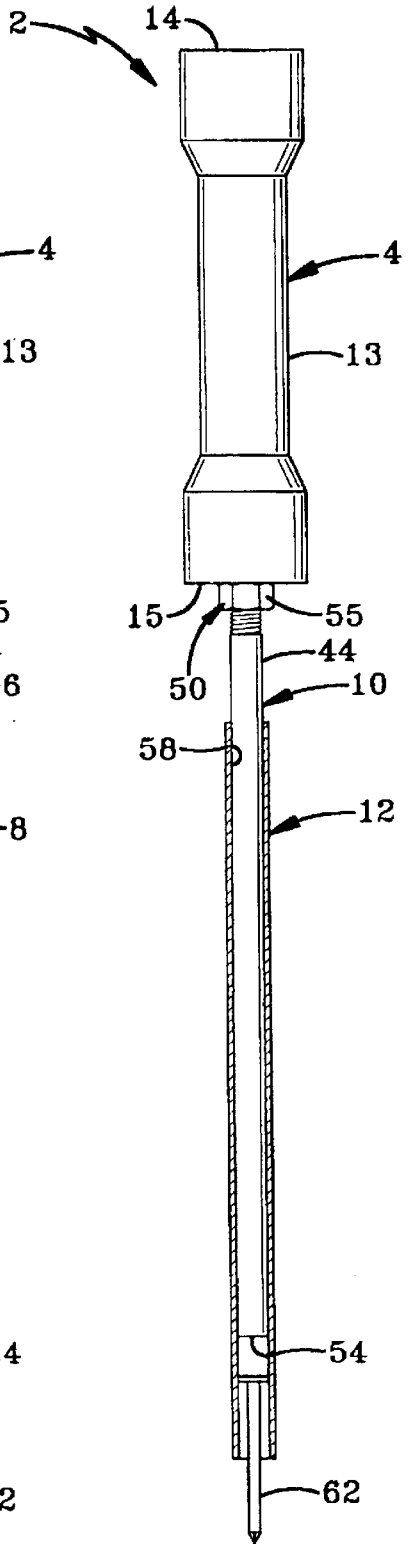
FIG. 5 is a front elevational view that is partially in section of a second configuration of the tool of the present invention.

As can be seen in FIG. 4, and in accordance with the objectives of the present invention, impact end 34 of first rod 8 is adapted to contact the head of a nail 42 which has been placed into first sleeve 8. First rod 6 is sufficiently long to fully drive nail 42 into a desired surface before nut 30 contacts first sleeve 8.

In use, nail 42 is inserted into first sleeve 8 as is shown in FIG. 4. The nail-containing end of first sleeve 8 is then placed against the surface where it is desired to drive nail 42. Driver 4 containing first rod 6 is repeatedly translated, thus sliding first rod 6 within first sleeve 8, causing impact end 34 to repeatedly contact nail 42 and to drive nail 42 into the surface. In accordance with the objectives of the present invention, the kinetic energy possessed by driver 4 while being translated is directed against nail 42 causing nail 42 to be driven into the surface. The risk of driver 4 accidentally contacting a wall or other such surface is greatly minimized because driver 4 does not need to be swung like a conventional hammer. The likelihood that impact end 34 slipping off nail 42 or entirely missing nail 42 is likewise greatly minimized because first rod 6 and nail 42 are both contained within first sleeve 8. The tendency of nail 42 to buckle upon impact is similarly minimized because nail 42 is contained within first sleeve 8. The elongated nature of first rod 6 and first sleeve 8 permit nail 42 to be driven into relatively inaccessible or tight places such as internal corners, blind holes, and the like.

Second rod 10 is of similar configuration to first rod 6, with second rod 10 having an outer surface 44, a attachment end 46 containing a plurality of external threads 48, a jam nut 50 with a locking surface 52 adjacent attachment end 46, and terminating at an impact end 54. Jam nut 50 contains at least a pair of parallel and spaced apart flats 55. Outer surface 44 has an external width 56 of substantially constant circular cross section.

Figure 7:
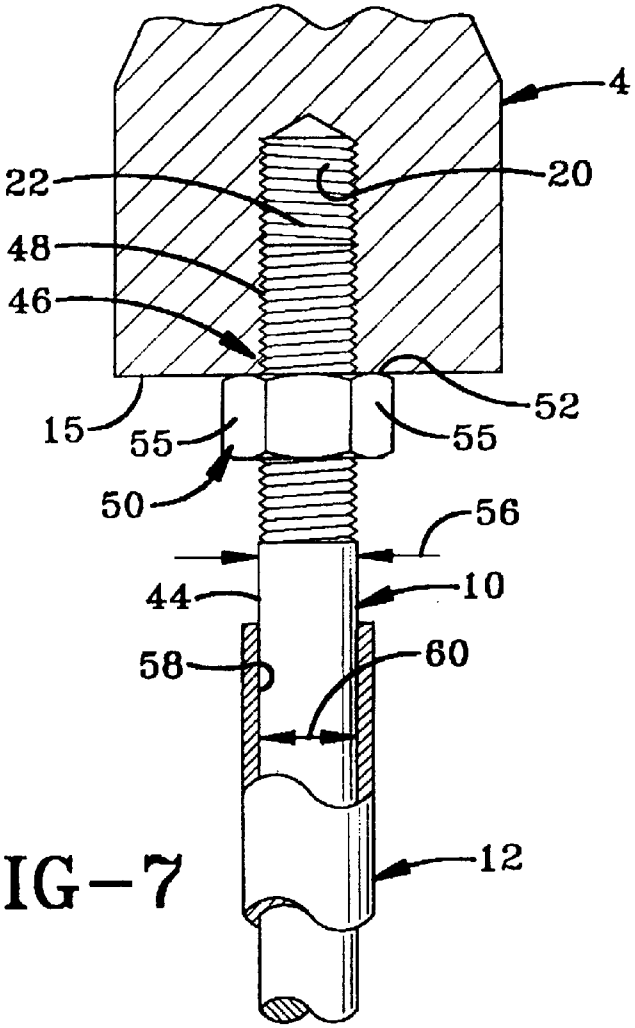
FIG. 7 is an enlarged front elevational view, partially in section, of a portion of the second configuration.

In accordance with the objectives of the present invention, attachment end 46 is threadably received within second hole 20 of driver 4, with external threads 48 cooperating with internal threads 22. Attachment end 46 is threadably inserted into second hole 20 and tightened therein until locking surface 52 of jam nut 50 is tightened against second end 15. As is best shown in FIG. 7, second hole 20 is preferably of sufficient depth to allow attachment end 46 to be fully threaded into second hole 20 with locking surface 52 of jam nut 50 tightened against second end 15.

In accordance with the objectives of the present invention, second rod 10 slides with respect to second sleeve 12. Second sleeve 12 is an elongated body formed with a substantially cylindrical second bore defining an arcuate inner surface 58 having an internal width 60. External width 56 of second rod 10 is preferably nominally smaller than internal width 60 of second sleeve 12 thus permitting second rod 10 to slide smoothly within second sleeve 12. Impact end 54 of second rod 10 contacts a nail 62 and drives nail 62 into a desired surface upon repeated translation of driver 4 with second rod 10 telescoping within second sleeve 12.

In accordance with the objectives of the present invention, external width 56 of second rod 10 is greater than external width 36 of first rod 6 thus permitting second rod 10 to drive larger nails than can be driven by first rod 6. While each of first and second rods 6 and 10 can drive nails within a certain range of sizes, the ability of driver 4 to accept either of first and second rods 6 and 10 permits driver 4 to be utilized to drive a greater range of nail sizes. The versatility afforded by driver 4 permits a wide variety of nail sizes to be driven by a single tool thus resulting in a significant weight savings for the workman who must carry his tools with him. As such, the workman need only carry a single driver 4 along with first and second rods 6 and 10 and first and second sleeves 8 and 12. All of the aforementioned parts of tool 10 will fit easily into a conventional tool belt of the type known and understood in the relevant art.

As set forth above, first and second rods 6 and 10 are both of a substantially circular cross section but are of different widths. First and second sleeves 8 and 12 are formed with correspondingly shaped and sized first and second substantially cylindrical bores upon which are defined inner surfaces 38 and 58. It is understood, however, that in other embodiments (not shown) first and second rods 6 and 10 could be of other non-circular cross sections, such as elliptical or polygonal, without departing from the spirit of the present invention so long as first and second rods 6 and 10 have different effective widths. The effective widths of non-circular first and second rods 6 and 10 could be defined in nearly any fashion by the user, such as the minimum distance between sides, the maximum distance between sides, the cross sectional area divided by the perimeter, or any other appropriate fashion. In such alternate embodiments, first and second sleeves 8 and 12 would be formed with correspondingly shaped and sized first and second bores upon which would be defined inner surfaces 38 and 58 that would telescopingly receive first and second rods 6 and 10, respectively. As such, the specific cross sectional shapes of first and second rods 6 and 10 can be varied so long as widths 36 and 56 of first and second rods 6 and 10, respectively, or the effective widths of non-circular first and second rods 6 and 10, are different.

The components of tool 2 will typically be carried in an unassembled fashion with one of first and second rods 6 and 10 being installed onto driver 4 as needed to correspond with a specific nail which is required to be driven into a surface. While it is preferred that driver 4 be manufactured of a material such as cast iron, and that first and second rods 6 and 10 and first and second sleeves 8 and 12 manufactured of materials such as steel, aluminum or titanium, it is understood that the electronegativity differences between the materials which could potentially result in corrosion thereof are relatively insignificant in this application inasmuch as the components of tool 2 are preferably carried and stored in an unassembled configuration. All of this not withstanding, a wide variety of materials can be used to manufacture driver 4, first and second rods 6 and 10, and first and second sleeves 8 and 12 without departing from the spirit of the present invention. Among the primary considerations in the selection of such materials will be that driver 4 be of a sufficient mass to readily drive nails, yet be of a small enough size to be carried in a conventional tool belt and held in the human hand, and that impact ends 34 and 54 of first and second rods 6 and 10 will withstand repeated driving of nails without deformation sufficient to interfere with the travel of first and second rods 6 and 10 through first and second sleeves 8 and 12.

It is likewise understood that first and second rods 6 and 10 are of widths corresponding with nails having the greatest prevalence in the applicable trade with which tool 2 will be used. It is also understood that tool 2 may have any of a number of rods and cooperating sleeves corresponding with any of a wide variety of nails and other fasteners used in the relevant trade. Moreover, it is understood that first and second rods 6 and 10 can drive fasteners other than nails, such as pins, tacks, brads, staples, and the like, and that the cooperating rods and sleeves could be of non-circular cross sections to correspond with the shape of the particular fasteners to be driven.

Figure 8:
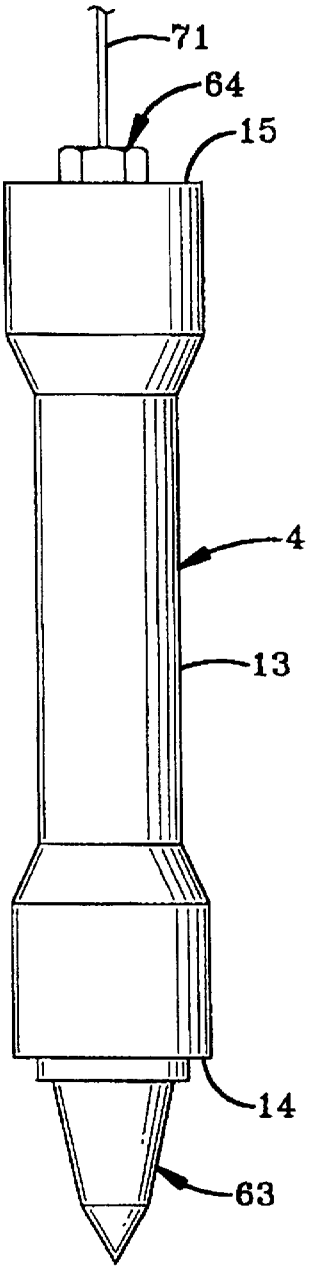
FIG. 8 is a front elevational view of a third configuration of the present invention.
Figure 9:
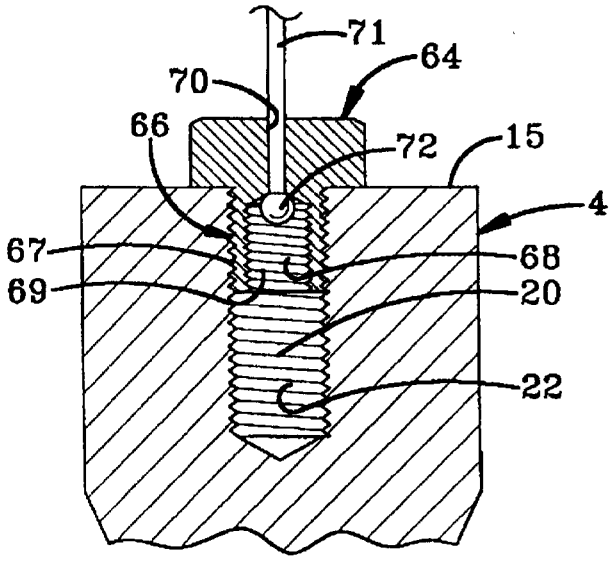
FIG. 9 is an enlarged front elevational view, partly in section, of a portion of the third configuration.
Figure 10:
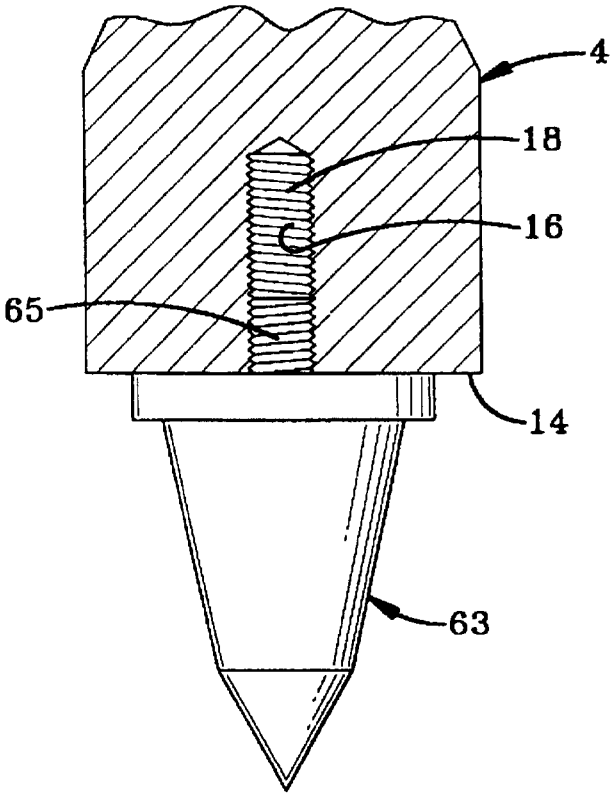
FIG. 10 is an enlarged front elevational view, partly in section, of a portion of the third configuration.

A third configuration of the present invention is depicted in FIGS. 8–10. The third configuration includes plumb bob tip 63 and string brace 64 attached to driver 4. Plumb bob tip 63 includes a threaded shank 65 that cooperates threadably with internal threads 18 and is threadably received within first hole 16. String brace 64 includes a shaft 66 having a plurality of external threads 67 formed thereon. External threads 67 cooperate threadably with internal threads 22 such that shaft 66 is threadably received within second hole 20. String brace 64 is additionally formed with a substantially cylindrical cavity 68 axially disposed and a plurality of internal threads 69 formed on cavity 68. String brace 64 is also formed with a string hole 70 axially disposed therein that receives a string 71 therethrough. String 71 preferably terminates at a substantially spherical block 72 disposed inside cavity 68, although block 72 could be of substantially any shape without departing from the spirit of the present invention so long as block 72 retains string 71 within string hole 70.

In accordance with the features of the present invention, the third configuration provides a plumb bob having a substantial weight that is especially useful in applications where a significant height, such as one or two stories or more, are required to have a plumb measurement performed thereon. Additionally, the heavy plumb bob provided by the third configuration is highly useful in windy conditions wherein a plumb bob of a relatively lighter weight might otherwise be blown about, thus preventing an accurate plumb measurement from being provided. In accordance with the features of the present invention, therefore, the heavy plumb bob provided by the third configuration of the present invention further permits tool 2 to be used in various special configurations without adding significant weight to the workman's toolbelt.

Figure 11:
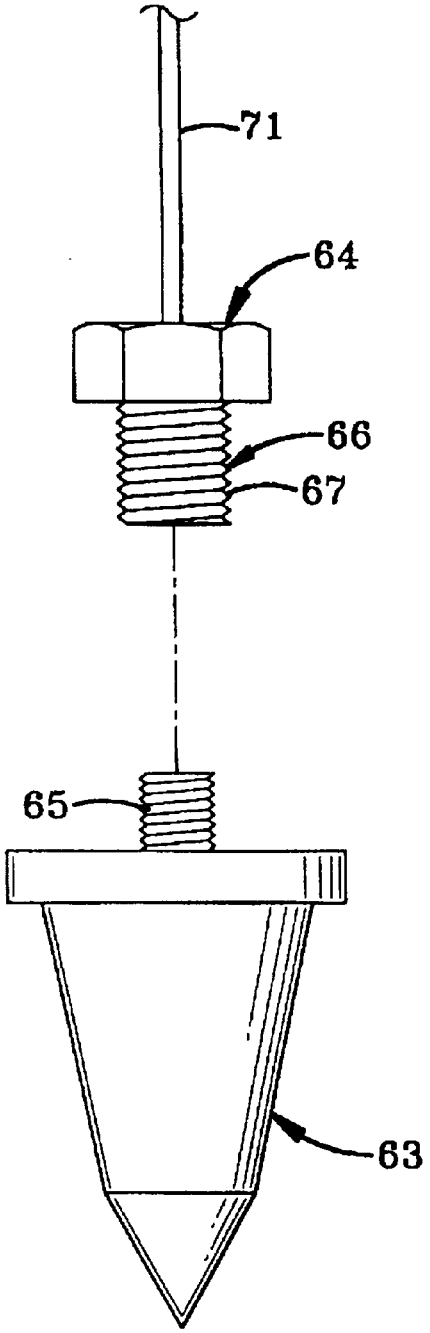
FIG. 11 is an exploded view of a fourth configuration of the present invention.
Figure 12:
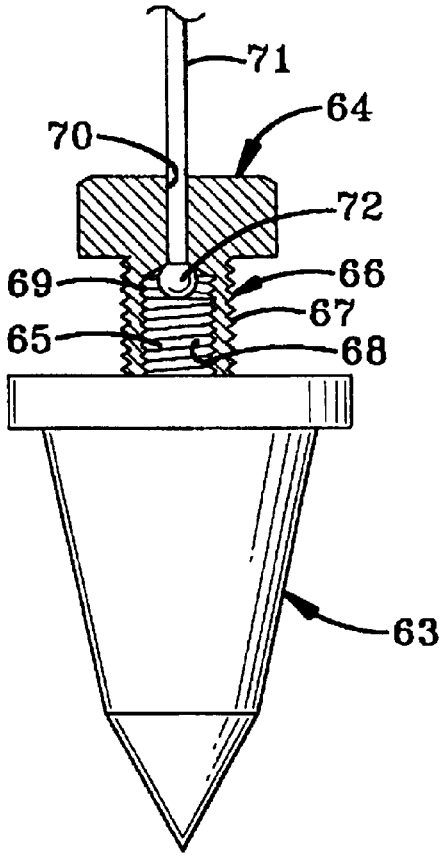
FIG. 12 is an enlarged front elevational view, partly in section, of the fourth configuration.

A fourth configuration of the present invention is depicted in FIGS. 11 and 12 wherein plumb bob tip 63 is attached directly to string brace 64 without the inclusion of driver 4. Internal threads 69 are configured to cooperate threadably with threaded shank 65, thus permitting threaded shank 65 of plumb bob tip 63 to be threadably received within cavity 68 of string brace 64. As such, the fourth configuration provides a plumb bob of a relatively lighter weight as compared with the third configuration. In accordance with the features of the present invention, the plumb bob presented by the fourth configuration can be used in applications wherein a heavy plumb bob is not required. Further in accordance with the features of the present invention, the fourth configuration provides a plumb bob of a relatively light weight without adding any additional weight to the workman's toolbelt.

Figure 13:
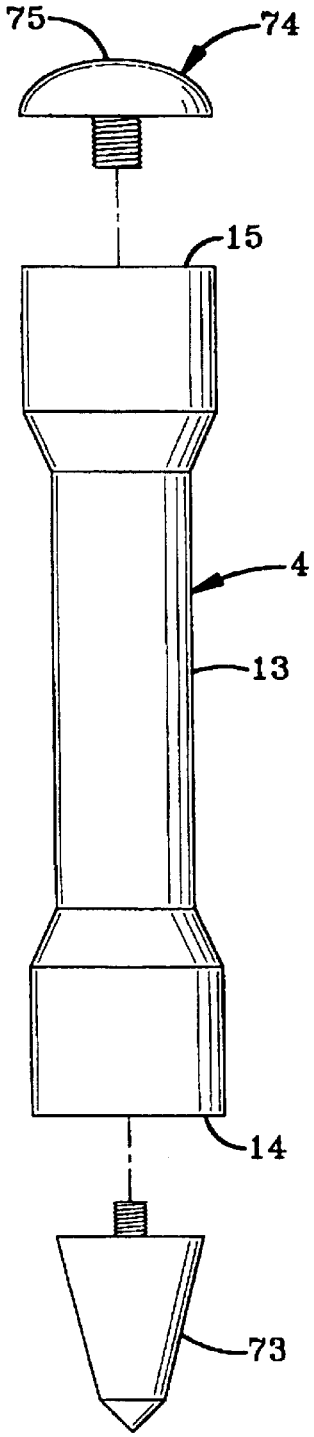
FIG. 13 is an exploded view of a fifth configuration of the present invention.
Figure 14:
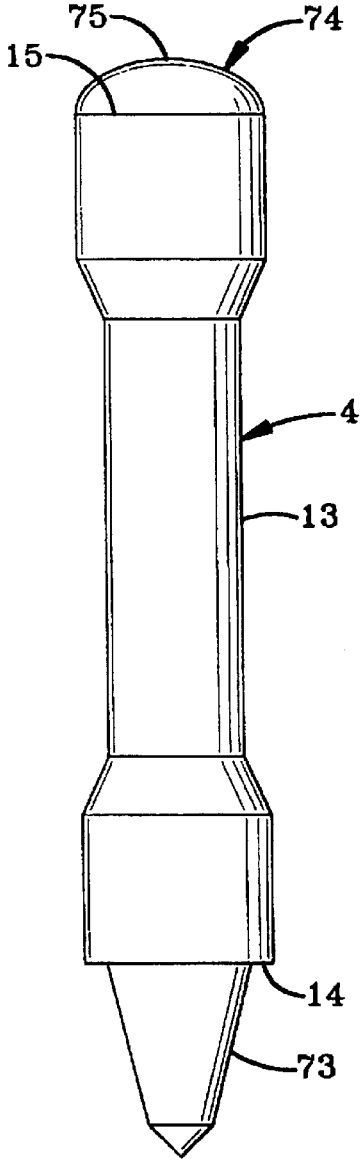
FIG. 14 is a front elevational view of the fifth configuration.

A fifth configuration of the present invention is depicted in FIGS. 13–14. The fifth configuration includes punch tip 73 and impact head 74 attached to driver 4. Punch tip 73 includes a threaded shank that is threadably received within first hole 16, and impact head 74 includes a threaded shank that is threadably received within second hole 20. The fifth configuration thus provides a heavy duty center punch that can be used by iron workers and other workmen who have a need to drill holes in relatively large and hard materials such as steel girders.

As is known and understood in the art, relatively hard, tough materials such as steel plates and girders must be center punched prior to drilling to provide an indentation in the material into which the drill bit can be seated prior to drilling. In the absence of a center punch indentation the drill bit will not drill a hole at the desired location but rather will travel about the surface by virtue of the rotational movement of the drill bit. When large holes are drilled in large steel members, a relatively large center punch must be used to punch a relatively large indentation into the surface prior to drilling. The fifth configuration thus provides a relatively large center punch that can be used to punch such large indentations into a surface.

Impact head 74 is formed with an impact face 75 that is configured to withstand repeated striking by a ball peen hammer or a sledgehammer in order to drive punch tip 73 into a surface to form an appropriate indentation (not shown) to facilitate drilling a hole into the surface. In accordance with the features of the present invention, therefore, the fifth configuration provides a heavy duty center punch without substantially increasing the weight that is added to the workman's toolbelt.

Figure 15:
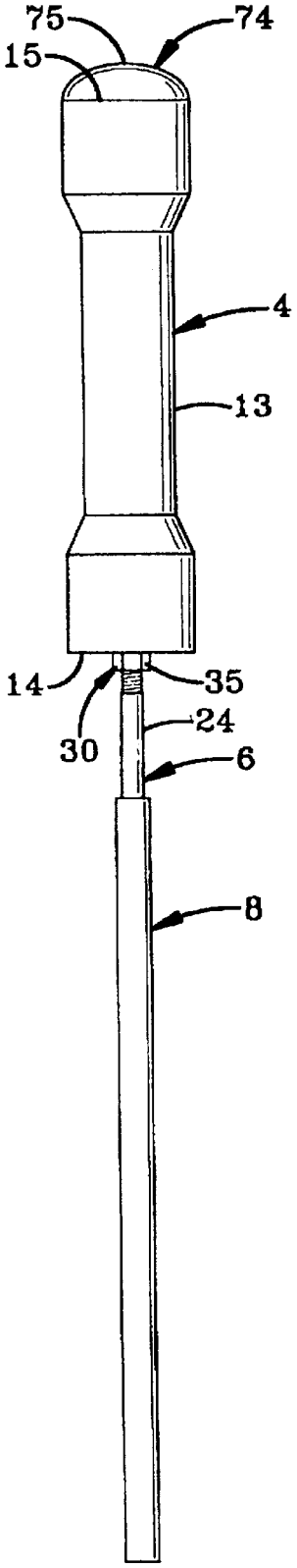
FIG. 15 is a front elevational view of a sixth configuration of the present invention.

A sixth configuration of the present invention is depicted in FIG. 15. The sixth embodiment provides a device that can drive nails and can additionally accept striking blows from ball peen hammers or sledgehammers to assist in the driving process. As can be seen in FIG. 15, the sixth embodiment essentially includes the first embodiment with the addition of impact head 74 received within second hole 20. The sixth configuration is useful for driving nails and other articles, and is especially useful in the installation and removal of wedge bolts (not shown) that are used in conjunction with form panels (not shown) into which uncured concrete is poured. Such wedge bolts are often tightly wedged between other cooperative structures and thus can be difficult to install and remove. Moreover, such wedge bolts may additionally be covered with cured concrete, thus making their removal even more difficult. It is understood, however, that the sixth configuration, as well as the first and second configurations, can be used in myriad applications including the installation of nails and the installation and removal of wedge bolts, as well as numerous other such uses. In accordance with the features of the present invention, therefore, the sixth configuration provides a device that can accurately focus the energy of a blow from a ball peen hammer or a sledgehammer onto a very small area.

Accordingly, the improved multi-purpose device of the present invention is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the multi-purpose tool device is constructed and used, the characteristics of the construction, and the advantageous new and useful results obtained; the new and useful structures, devices, elements, arrangements, parts, and combinations are set forth in the appended claims.

I claim:

1. A multi-purpose tool for driving a fastener into a substrate, said tool comprising:

a weighted driver;

a first rod having an impact end and an attachment end, said attachment end of said first rod being selectively connectable to said weighted driver, said impact end adapted to impact the fastener;

a first sleeve formed with a first bore therein, said first rod configured to slide within said first bore, said first bore adapted to accept the fastener therein;

a second rod having an impact end and an attachment end, said attachment end of said second rod being selectively connectable to said weighted driver, said impact end adapted to impact the fastener;

a second sleeve formed with a second bore therein, said second rod configured to slide within said second bore, said second bore adapted to accept the fastener therein; and the widths of said first and second rods being unequal whereby said first and second bores can accept fasteners of different sizes.

2. The tool as set forth in claim 1 in which said weighted driver is formed with a first threaded hole, said attachment end of one of said first and second rods being configured to be selectively received in said first threaded hole.

3. The tool as set forth in claim 2 in which said weighted driver is formed with a second threaded hole, said attachment end of the other of said first and second rods being configured to be selectively received in said second threaded hole.

4. The tool as set forth in claim 3 in which each of said first and second rods includes a locking surface, each of said locking surfaces adapted to be selectively tightened against said driver.

5. The tool as set forth in claim 4 in which each of said rods includes at least a pair of flats.

6. The tool as set forth in claim 3 in which said first and second threaded holes are disposed at opposite ends of said driver.

7. The tool as set forth in claim 6 in which said first and second threaded holes are coaxial.

8. A method for driving a fastener into a substrate, said method comprising the steps of:

providing a weighted driver and a first rod, the first rod configured to be selectively carried by the driver, a first sleeve, the first rod adapted to slide within the first sleeve, a second rod, the second rod adapted to be selectively carried by the driver, and a second sleeve, the second rod adapted to slide within the second sleeve, the first and second rods being of different widths;

selecting one of the first and second rods;

attaching the selected rod to the driver;

sliding the selected rod through the correspondingly sized sleeve to contact the fastener; and translating the weighted driver repeatedly and causing the selected rod to repeatedly impact the fastener until the fastener is driven into the surface.

9. A multi-purpose tool that can be assembled in a variety of configurations for performing various functions, the tool comprising:

a weighted driver, a first rod and sleeve assembly, a second rod and sleeve assembly, a plumb bob tip, a string brace formed with a cavity, a punch tip, and an impact head;

said weighted driver having first and second opposite ends;

said weighted driver having a first hole in said first end and a second hole in said second end;

said first rod and sleeve assembly including a first rod and a first sleeve; said first rod being slidably receivable in said first sleeve;

said first rod being selectively received in said first hole of said weighted driver;

said second rod and sleeve assembly including a second rod and a second sleeve; said second rod being slidably receivable in said second sleeve;

said second rod being selectively received in said second hole of said weighted driver;

said first rod having a smaller width than said second rod;

said plumb bob tip being selectively received in said first hole;

said string brace being selectively received in said second hole;

said punch tip being selectively received in said first hole; and said impact head being selectively received in said second hole.

10. The tool as set forth in claim 9 wherein a first configuration includes said first rod being received in said first hole and said first rod being slidably received in said first sleeve.

11. The tool as set forth in claim 9 wherein a second configuration includes said second rod being received in said second hole and said second rod being slidably received in said second sleeve.

12. The tool as set forth in claim 9 wherein a third configuration includes said plumb bob tip being received in said first hole and said string brace received in said second hole.

13. The tool as set forth in claim 9 wherein a fourth configuration includes said plumb bob tip being received in said cavity of said string brace.

14. The tool as set forth in claim 9 wherein a fifth configuration includes said punch tip being received in said first hole and said impact head being received in said second hole.

15. The tool as set forth in claim 9 wherein a sixth configuration includes said first rod being received in said first hole, said first rod being slidably received in said first sleeve, and said impact head being received in said second hole.

16. A tool set comprising:

a driver;

a first rod, a second rod, a plumb bob tip, and a punch tip selectively mountable on said driver;

said first rod telescopable within a first sleeve formed with a first bore therethrough;

the second rod telescopable within a second sleeve formed with a second bore therethrough;

the widths of said first and second rods being unequal.

17. The tool as set forth in claim 16, further comprising an impact head mountable on said driver when said punch tip is mountable on said driver.

18. The tool as set forth in claim 16, further comprising an impact head mountable on said driver when said first rod is mountable on said driver.

19. The tool as set forth in claim 16, further comprising a string brace mountable on said driver when said plumb bob tip is mountable on said driver.

20. The tool as set forth in claim 19 wherein said plumb bob tip and said string brace are detachable from said driver, said plumb bob tip and said string brace being attachable to one another free of said driver.

* * * * *